US010822880B2

(12) United States Patent
Knott

(10) Patent No.: US 10,822,880 B2
(45) Date of Patent: Nov. 3, 2020

(54) GOLF TEE INSERT DEVICE AND METHOD FOR INSERTING A GOLF TEE INTO THE GROUND

(71) Applicant: Amy Knott, Thornton, CO (US)

(72) Inventor: Amy Knott, Thornton, CO (US)

( * ) Notice: Subject to any disclaimer, the term of this patent is extended or adjusted under 35 U.S.C. 154(b) by 1 day.

(21) Appl. No.: 16/258,402

(22) Filed: Jan. 25, 2019

(65) Prior Publication Data

US 2019/0224541 A1 Jul. 25, 2019

Related U.S. Application Data

(60) Provisional application No. 62/621,983, filed on Jan. 25, 2018.

(51) Int. Cl.

| | |
|---|---|
| ***E21B 7/26*** | (2006.01) |
| ***A63B 57/00*** | (2015.01) |
| ***A63B 1/00*** | (2006.01) |

(52) U.S. Cl.

CPC ..... *E21B 7/26* (2013.01); *A63B 1/00* (2013.01); *A63B 57/0012* (2013.01); *A63B 57/0037* (2013.01)

(58) Field of Classification Search

CPC ... E21B 7/26; A63B 57/0037; A63B 57/0012; A63B 1/00

See application file for complete search history.

(56) References Cited

U.S. PATENT DOCUMENTS

| | | | | |
|---|---|---|---|---|
| 1,906,706 | A * | 5/1933 | Moore | E21B 7/18 175/21 |
| 2,574,605 | A * | 11/1951 | Pelt | E21B 4/08 175/19 |
| 2,609,198 | A * | 9/1952 | Armstrong | A63B 57/0037 473/133 |
| 2,786,450 | A | 3/1957 | Jacobus et al. | |
| 3,086,501 | A | 4/1963 | Nielsen | |
| 3,494,431 | A | 2/1970 | Yoho et al. | |
| 3,576,064 | A | 4/1971 | Brackin | |
| 3,671,037 | A * | 6/1972 | Murdock, Jr. | A63B 57/0037 473/386 |
| 3,923,228 | A | 12/1975 | Leff et al. | |
| 4,313,604 | A | 2/1982 | Baxter | |
| 4,360,199 | A * | 11/1982 | Jackson | A63B 57/0037 473/132 |
| 4,545,440 | A | 10/1985 | Treadway | |
| 4,706,869 | A | 11/1987 | Knispel et al. | |
| 4,793,063 | A | 12/1988 | Ducret | |
| 5,494,279 | A * | 2/1996 | Ahner | A63B 57/0037 473/386 |

(Continued)

FOREIGN PATENT DOCUMENTS

| | | |
|---|---|---|
| CN | 2480114 | 3/2002 |
| CN | 2604283 | 2/2004 |

(Continued)

*Primary Examiner* — Nicole Coy
(74) *Attorney, Agent, or Firm* — Sheridan Ross P.C.

(57) ABSTRACT

A golf tee insert device is provided herein. More specifically, a hand-held device for punching a hole in the ground is provided, where the hole is designed to receive a golf tee. The device may include a punch that is spring-activated, pneumatic, or electromagnetic. The punch is propelled out of the device a predetermined distance to create a tee-sized hole in the ground.

20 Claims, 14 Drawing Sheets

(56) References Cited

U.S. PATENT DOCUMENTS

| | | | | |
|---|---|---|---|---|
| 5,540,432 | A * | 7/1996 | Keller | A63B 57/0037 473/386 |
| 5,645,498 | A * | 7/1997 | Cretella | A63B 57/0037 473/286 |
| 5,657,676 | A | 8/1997 | Koller | |
| 5,669,646 | A * | 9/1997 | Fiocca | A63B 57/0037 294/24 |
| 6,672,977 | B1 * | 1/2004 | Colbo | A63B 47/02 294/19.2 |
| 6,705,503 | B1 | 3/2004 | Pedicini et al. | |
| 6,723,010 | B2 * | 4/2004 | Gill | A63B 57/0037 473/386 |
| 6,997,367 | B2 | 2/2006 | Hu | |
| 7,028,360 | B2 | 4/2006 | Eldar | |
| 7,152,774 | B2 | 12/2006 | Chen | |
| 7,424,840 | B1 | 9/2008 | Huang | |
| 8,529,379 | B1 * | 9/2013 | Faircloth | A63B 47/02 294/19.2 |
| 8,870,686 | B1 * | 10/2014 | Johnson | A63B 57/0037 473/386 |
| 9,950,227 | B1 * | 4/2018 | Faircloth | A63B 57/0037 |
| 2004/0232194 | A1 | 11/2004 | Pedicini et al. | |
| 2006/0014596 | A1 * | 1/2006 | Marcus | A63B 57/0037 473/386 |
| 2008/0179099 | A1 | 7/2008 | McNulty | |
| 2008/0190988 | A1 | 8/2008 | Pedicini et al. | |
| 2009/0017942 | A1 * | 1/2009 | Guldenring | A63B 57/0037 473/386 |
| 2009/0236387 | A1 | 9/2009 | Simonelli et al. | |

FOREIGN PATENT DOCUMENTS

| | | |
|---|---|---|
| CN | 2744309 | 12/2005 |
| CN | 202461268 | 10/2012 |
| CN | 202985516 | 6/2013 |
| CN | 204248826 | 4/2015 |
| CN | 205464446 | 8/2016 |
| CN | 206273416 | 6/2017 |
| CN | 107571204 | 1/2018 |
| KR | 10-2004-0102809 | 12/2004 |
| KR | 10-2010-0033668 | 3/2010 |
| RU | 2021862 | 10/1994 |

* cited by examiner

GOLF TEE INSERT DEVICE AND METHOD FOR INSERTING A GOLF TEE INTO THE GROUND

CROSS REFERENCE TO RELATED APPLICATIONS

This application claims priority from U.S. Provisional Patent Application Ser. No. 62/621,983, filed Jan. 25, 2018, entitled "Golf Tee Insert Device"; the entire disclosure of which is hereby expressly incorporated by reference in its entirety.

FIELD OF THE INVENTION

Embodiments of the present invention generally relate to a golf tee insert device, and more specifically to a hand-held device for punching a hole in the ground, where the hole is designed to receive a golf tee.

BACKGROUND OF THE INVENTION

At times it can be difficult to push a golf tee into the ground, especially if the ground is cold and/or hard. Moreover, some golf tees are not strong enough or do not have a pointy enough end to be pushed into the hard ground without breaking. In the past, golfers have tried to push the golf tee slowly into the ground or step on the golf tee slowly such that the golf tee may enter the ground without breaking. Alternatively, golfers may use a hammer and nail, a screw driver, or an ice pick to create a hole in the ground before pushing their tees into the hard ground.

Accordingly, there exists a significant need for a compact, light-weight device that can create a hole in the ground, where the hole is designed to receive a golf tee.

SUMMARY OF THE INVENTION

These and other needs are addressed by the various embodiments and configurations of the present invention. This invention relates to novel devices and methods for providing a hole in the ground designed to receive a golf tee. The novel devices provided herein allow the user to punch a hole in the hard ground before inserting a golf tee into the ground, and specifically into the hole.

It is one aspect of embodiments of the present invention to provide a device for creating a hole in the ground, where the hole is shaped and sized to receive a golf tee.

It is another aspect of embodiments of the present invention to provide a portable, hand-held device for creating a hole in the ground, where the hole is shaped and sized to receive a golf tee. In some embodiments, the device can be compact and stored in the user's golf bag.

It is a further aspect of embodiments of the present invention to provide a punch device for punching a hole in the ground for a golf tee. In some embodiments, the punch device includes a punch for punching a hole in the ground. The punch may be any hard material known in the art, including metal, hard plastic, ceramic, carbon fiber, wood, etc., or combinations of these materials. The punch may be sized and shaped similar to a golf tee. Further, the punch can have a pointed distal end for first entering the ground. In various embodiments, the punch device can have a trigger for punching the punch into the ground.

It is another aspect of embodiments of the present invention to provide a simple device for creating a hole in the ground, where the hole is shaped and sized to receive a golf tee. The device may be devoid of electrical components. Rather, the device may merely have a spring-activated punch controlled by a trigger mechanism. Thus, in some embodiments, the device can be a spring-powered tool that may be similar to a trigger gun. Further, when the trigger is compressed, a spring mechanism is activated that drives the punch swiftly into the ground. It is one advantage of these simple embodiments that no power cord or heavy batteries are needed. Further, the design requires fewer components to break or fail; thus, the device will be more reliable and last longer than more complicated designs with numerous components.

However, in other embodiments, the device may be electric (battery-operated) or pneumatic (air-powered). Electric or pneumatic embodiments require less strength on behalf of the user, but may be heavier and have more components that simple spring-activated designs.

In some embodiments, the device may comprise various punches of differing shapes and sizes depending on the specific tee the user uses. The punches may be screwed or inserted into the device such that the punch can be removed by unscrewing the proximal end of the punch. Then the user can screw in or insert a different-sized punch. Thus, the proximal end of the punch may be threaded, and the device may comprise a threaded opening for receiving the threaded end of the punch. In other embodiments, the punch may be held in the device in ways other than using threads. For example, the device may have a clamping system using levers, springs, notches, protrusions, detents, and/or cams to hold the differently-sized punches in place.

In various embodiments, the punch can have a smooth outer surface. In other embodiments, the outer surface of the punch may be textured. In still further embodiments, the proximal end of the punch may be threaded, and the distal end of the punch may be smooth or textured.

In some embodiments, the device can comprise a trigger, which the user pulls or depresses to punch/shoot the punch into the ground. In other embodiments, the device can include a trigger lever, which the user pulls or depresses to punch/shoot the punch into the ground. In some embodiments, the racking lever is the trigger mechanism; thus, the user pulls the racking lever and then releases the racking lever to shoot the punch. Although some embodiments are described as having a trigger, any triggering mechanism can be used, for example, a trigger lever or other pull mechanism.

In various embodiments, the handle of the device can include rubber for easy gripping. In other embodiments, at least a portion of the handle can include a gripping material, such as rubber or soft plastic. In additional or alternative embodiments, the handle, trigger, and/or safety may be cushioned for improved gripping and comfort. Alternatively, the handle and trigger may be a smooth hard material, such as plastic or metal.

The device can work in a number of ways. For example, in some embodiments, the proximal end of the punch can be interconnected to a spring inside the device. As the user pulls the trigger or pushes on the trigger lever, an internal member interconnected to the proximal end of the punch pulls the punch up into the device (e.g., into the head of the device) toward the rear end of the device or head. The device may comprise a spring interconnected to the proximal end of the punch and the rear end of the device or head. As the punch is pulled toward the rear end of the device or head, the spring interconnected to the proximal end of the punch can be compressed. At the end of the trigger movement, the internal member can release the punch and the spring can push the punch toward the front end of the device or head. Thus, the punch can be shot outward from the front end of the device or head. The punch can be pulled into the device and shot out a predetermined distance. In some embodiments, the predetermined distance can be between about 0.50 inches and about 2.50 inches. In a preferred embodiment, the predetermined distance can be between about 0.75 inches and about 2.0 inches. In a more preferred embodiment, the predetermined distance can be between about 1.25 inches and about 1.75 inches. In a more preferred embodiment, the predetermined distance can be about 1.5 inches.

In some embodiments, the device can have punch extending out of the front end of the head of the device. The device can have a racking lever, which pulls the punch into the head of the device and compresses a spring connected to the punch. The device can have a safety to prevent inadvertent firing. For example, a lever may rest in a notch of the punch or a racking lever can be positioned in a cutout or notch to prevent the punch from shooting. The device has a handle with a trigger. After the punch has been pulled into the head of the device and compressed the spring, the user can pull the trigger to shoot the punch out of the head and into the ground. When the trigger is pulled, a flange connected to the trigger can push on the lever and rotate the lever such that a portion of the lever positioned in the punch notch is released from the notch, allowing the punch to be propelled forward by the force of the spring.

In various embodiments, the device may work similar to a manual staple gun: when the user compresses the trigger, the spring mechanism can be activated and drive the punch out of the head of the device. In some embodiments, when the trigger, trigger lever, or other activating squeeze mechanism is pulled or pushed, it can lift a plunger (which may be a piston) to engage bent tension bars, which slip off hooks and onto a loader, snapping the firing piston and sending out the punch.

In other embodiments, the device may be pneumatic and use a similar hammer to a solenoid nail gun. These embodiments include a sliding piston that drives a long blade. When the air pressure above the piston head is greater than below it, the piston is forced downward. When the air pressure below the piston is greater than above it, the piston stays up. The trigger mechanism can serve to channel the flow of compressed air to shift this balance. In these embodiments, a movable valve plunger can sit above the piston head. When the trigger is in the released position, compressed air can flow to both sides of the valve plunger. The compressed air can flow directly through the air reservoir to a lip around the bottom of the plunger, through the trigger valve and a small plastic tube until it reaches the area above the plunger. Since compressed air flows to both sides of the plunger, the air pressure balances out. The plunger is also attached to a spring, which pushes the plunger downward, and shifts the pressure balance. When the trigger is released, there is always greater pressure above the plunger than below it. This imbalance keeps the plunger pressed against the seal surrounding the piston head. With the plunger in this position, the compressed air flowing into the gun cannot reach the top of the piston to push it down.

Thus, in the pneumatic device, the trigger valve can close and open a passageway to the atmosphere. With the trigger valve in the closed position, the compressed air cannot flow to the area above the valve plunger and there is greater pressure below the plunger than above it. The plunger rises up and the compressed air makes its way to the piston head. The compressed air drives the piston and the blade downward, propelling the punch out of the chamber/head of the device. As the piston slides downward, it can drive the air inside the cylinder through a series of holes (e.g., 2 to 50 holes) into a return air chamber. As more air is pushed into the chamber, the pressure level rises. When the user releases the trigger, compressed air pushes the plunger back into place, blocking the air flow to the piston head. With no downward pressure, the compressed air in the return air chamber can push the piston head back up. The air above the piston head is forced out of the gun, into the atmosphere.

In still further embodiments, the punch device can include a solenoid, which is an electromagnet used in a variety of machines. Electromagnetic devices run electricity through a wire to generate a magnetic field. The magnetic field can be amplified by winding the charged wire in a coil. Just like a permanent magnet, an electromagnetic field has a polar orientation: a "north" end and a "south" end. In an electromagnet, the orientation of the poles can be altered by reversing the flow of the current. A solenoid is an electromagnetic coil with a sliding piston inside it. In the punch device, the piston can include a magnetic material, for example ferrites, metal oxides comprising iron, nickel or cobalt, alloys comprising iron, nickel or cobalt, sulfides comprising iron, nickel or cobalt, metal oxyhydroxides, similar materials, or combinations thereof. When the current is applied one way through the coil, the electromagnetic field repels the magnetic piston, pushing it out. When the current is reversed, the polar orientation switches and the electromagnet draws the piston back in. Some embodiments of the device can also include a spring mechanism to draw the piston back in. Thus, in these embodiments of the device, the solenoid can be used as a hammer to push the punch out of the device and into the ground. When the user pulls the trigger, the electrical circuit can run the current through the electromagnet so that the piston extends downward. The piston can be attached to a sturdy blade and the blade makes contact with the punch, forcing the punch out of the front end of the head of the device or gun. At the bottom of the cylinder, the piston can hit an electrical switch. Throwing this switch reverses the electrical current running through the electromagnet. The electromagnet can then draw the piston back into the head of the device for another hit.

In some embodiments, the device can include a cap to cover the punch when the device is not in use, i.e., when the device is stored in the user's golf bag. Additionally or alternatively, the device may include a bag or case for holding the device that can be detachably interconnected to a golf bag. In some embodiments, the device can include a safety or a lock for safety purposes. For example, the device may have a safety mechanism around the punch that must be compressed to permit the punch to shoot out, similar to the safety mechanism on some nail guns. The safety mechanism may also conceal the punch when the device is not in use and is stored in the user's golf bag. In other embodiments, the trigger may have a safety mechanism that must be compressed to permit the trigger to be depressed, similar to safeties on some handguns. In still other embodiments, the punch may be removed from the device for storage. Thus, the device may have a clip to hold the punch(es) or the device may have a carrying bag or pouch that also includes a section for the punch(es).

It is another aspect of embodiments of the present invention to provide a device that can also remove tees from the ground. Thus, some embodiments of the present invention can include a tee remover mechanism on the rear end of the device head. The tee remover mechanism may fold in and out such that it does not catch on items when it is not in use. In some embodiments, the tee remover mechanism looks similar to and functions similar to a staple remover. Thus, the tee remover mechanism may have two claw-like portions that are parallel to one another or are positioned at an angle relative to one another. In other embodiments, the tee remover looks similar to the claw on the rear end of the head of a hammer. In some embodiments, the tee remover looks similar to a bottle opener. In various embodiments, the tee remover has a keyhole slot sized to receive and hold the head of the tee. The keyhole slot may be positioned on a raised platform on the device such that the tee head will fit in between the platform and the device.

In some embodiments, a method of punching a hole into the ground is provided, where the hole receives a golf tee. The method comprises: placing the distal end of the punch on the ground and aligning the device such that the front end of the head of the device is closer to the ground than the rear end of the head of the device; deploying a punch; creating a hole in the ground by extending the punch into the ground; pulling the device away from the ground and pulling the punch out of the ground; and inserting a tee into the hole. The punch can be deployed by pulling a trigger or by some other deploying mechanism.

In some embodiments, a device for creating a hole in the ground is provided, the device comprising: a handle; a head interconnected to the handle, the head comprising a front end and a rear end; a punch extending outwardly from the front end of the head, the punch comprising: a tip on a first end; a proximal end opposite the tip, the proximal end positioned in the head; a cylindrical portion between the tip and the proximal end; an indention in the cylindrical portion and positioned a predetermined distance from the tip; and a stop ring positioned proximate the proximal end; a racking lever interconnected to the punch, wherein one end of the racking lever engages the stop ring; a trigger mechanism comprising a flange extending from an upper portion of the trigger mechanism; a locking lever rotatable around a pivot point, wherein the locking lever comprises a cutout sized and shaped to receive a distal end of the flange, and wherein the locking lever comprises a head with a nose, the nose sized and shaped to engage the indention in the punch; and a spring interconnected to the rear end of the head and the proximal end of the punch.

In some embodiments, the hole is sized and shaped to receive a golf tee. In some embodiments, the trigger mechanism further comprises a trigger positioned on a front end of the handle and a spring interconnected to the trigger and a rear end of the handle. In some embodiments, the device further comprises a tee extractor on the rear end of the head. In some embodiments, the head of the locking lever further comprises a butt end opposite the nose, wherein the butt end is interconnected to a biasing member, wherein the head of the locking lever is on one side of the pivot point and the cutout is on an opposite side of the pivot point. In some embodiments, the racking lever can slide along a portion of the cylindrical portion of the punch. In some embodiments, as the trigger mechanism is pulled, the flange of the trigger mechanism pushes on a tail end of the locking lever and rotates the locking lever around the pivot point, and wherein the tail end of the locking lever is on an opposite side of the pivot point as the head and nose of the locking lever. In some embodiments, the punch extends outward from the front end of the head of the device a distance between about 1.25 inches and about 1.75 inches. In some embodiments, a material of the punch comprises a metal, a hard plastic, a composite material, or combinations thereof.

In some embodiments, a device for creating a hole in the ground is provided, the device comprising: a handle; a head interconnected to the handle, the head comprising a front end, a rear end, and a cutout on a side; a punch extending outwardly from the front end of the head, the punch comprising: a tip on a first end; a proximal end opposite the tip, the proximal end positioned in the head; and a cylindrical portion between the tip and the proximal end; a racking lever interconnected to the punch proximate the proximal end, the racking lever having a distal end extending out of the cutout in the head; a trigger mechanism; and a spring interconnected to the rear end of the head and the proximal end of the punch.

In some embodiment, a method of using a device to punch a hole in the ground is provided comprising: providing a device comprising: a handle; a head interconnected to the handle, the head comprising a front end and a rear end; a punch extending outwardly from the front end of the head, the punch comprising: a tip on a first end; a proximal end opposite the tip; an indention a predetermined distance from the tip; and a stop ring positioned proximate the proximal end; a racking lever interconnected to the punch, wherein one end of the racking lever engages the stop ring; a trigger mechanism comprising a trigger; a locking lever rotatable around a pivot point, wherein the locking lever comprises a head with a nose, the nose sized and shaped to engage the indention in the punch; and a spring interconnected to an inner surface on the rear end of the head and the proximal end of the punch; pulling the racking lever toward the rear end of the head until the nose of the locking lever engages the indention in the punch; compressing the trigger; and driving the punch out of the head of the device and into the ground.

In some embodiments, the pulling comprises engaging the racking lever with the stop ring and pulling the punch rearward along with the racking lever. In some embodiments, the trigger mechanism comprises a spring interconnected to the trigger and an inner surface of a rear end of the handle, and wherein the spring returns the trigger to its original resting position. In some embodiments, as the trigger is compressed a flange on the trigger mechanism pushes on a tail end of the locking lever and rotates the locking lever around the pivot point. In some embodiments, as the locking lever rotates around the pivot point, the nose of the locking lever slides out of the indention in the punch. In some embodiments, after the nose of the locking lever slides out of the indention in the punch, a force exerted by the spring propels the punch forward and out of the head of the device. In some embodiments, the tail end of the locking lever is on an opposite side of the pivot point as the head and nose of the locking lever. In some embodiments, the method further comprises rotating the racking lever into a notch in an outer casing of the head, wherein the notch retains the racking lever and the punch in the loaded position and acts as a safety to prevent inadvertent firing of the punch. In some embodiments, the device is pneumatic and comprises a piston, and wherein when air pressure above the piston is greater than below the piston, the piston is forced forward and pushes the punch forward and out of the head of the device. In some embodiments, the device comprises a solenoid having an electromagnetic coil and a sliding piston, and wherein the method further comprises: creating a magnetic field; and repelling the piston such that the piston pushes the punch out of the head of the device.

Note that although various embodiments describe a system with a spring, any biasing member can be used, for example, a leaf spring, a coil spring, an elastic strap or band, and other devices.

The phrases "at least one", "one or more", and "and/or", as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B, and C together.

Unless otherwise indicated, all numbers expressing quantities, dimensions, conditions, and so forth used in the specification and claims are to be understood as being modified in all instances by the term "about". Furthermore, ranges have been discussed and used within the description. One skilled in the art would understand that any sub-range within the stated range would be suitable, as would any number within the broad range, without deviating from the invention.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings.

BRIEF DESCRIPTION OF THE DRAWINGS

Those of skill in the art will recognize that the following description is merely illustrative of the principles of the invention, which may be applied in various ways to provide many different alternative embodiments. This description is made for illustrating the general principles of the teachings of this invention and is not meant to limit the inventive concepts disclosed herein.

The accompanying drawings, which are incorporated in and constitute a part of the specification, illustrate embodiments of the invention and together with the general description of the invention given above and the detailed description of the drawings given below, serve to explain the principles of the invention.

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

Figure 1:
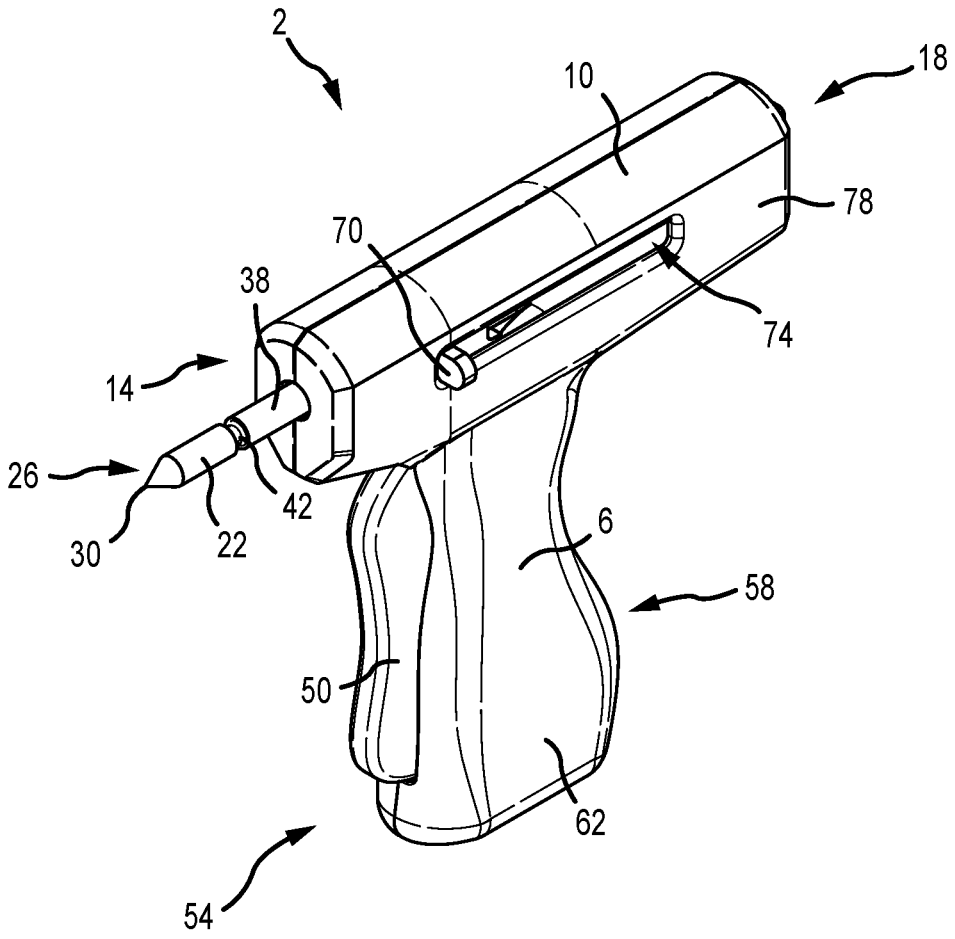
FIG. 1 is a right front perspective view of embodiments of a device for creating a hole in the ground for a golf tee.

FIG. 1 illustrates embodiments of a device 2 for creating a hole in the ground and is a right front perspective view of the device 2. The device 2 comprises a handle 6 interconnected to a head 10. The head 10 has a front end 14 opposite a rear end 18. The head 10 and the handle 6 may be the same material or different materials. For example, both may be a hard plastic, a composite material, metal, or any other durable material known in the art. Preferably, the material is also light weight. Coatings can be applied to the head 10 or handle 6 to assist with gripping, identification, durability, and/or aesthetics. Layers of additional materials can be secured to the surface of the head 10 and/or handle 6. For example, a thin rubber layer can be adhered to the handle 6 to assist with gripping.

A punch 22 extends outward from the front end 14 of the head 10. The punch 22 has a distal end 26 with a tip 30 and a proximal end 34 (not shown because it is inside of the device 2) opposite the distal end 26. The tip 30 may be pointed, angled, and/or rounded to assist in forming the hole in the ground. The punch 22 also has a shaft or cylindrical portion 38 with an indention 42. In some embodiments the indention 42 goes all the way around the punch (360'). In some embodiments the indention 42 is only on one side of the punch 22. The cylindrical portion 38 may be sized and shaped similar to the shaft of a golf tee. The device 2 may have different punches 22 that are different sizes based on the specific tee used by the golfer. The punch 22 can be metal, wood, ceramic, composite, hard plastic, stone, any other material known in the art, or combinations thereof.

The head 10 also includes a lever 70 (also called a "racking lever" herein) for pulling the punch 22 into the head 10. See the description associated with FIGS. 9-12A and 15-16 for more information on the racking lever 70. The head 10 has a right side 78 and a left side (not shown in FIG. 1). The racking lever 70 slides along the cutout 74 (also called an "opening" herein), which runs along the right side 78 of the head 10. In other embodiments, the cutout 74 and racking lever 70 may be positioned on the left side of the head 10. In some embodiments, the cutout 74 can be present on both the right side 78 and the left side of the head 10 and a racking lever 70 can be present on both sides of the head 10.

The handle 6 can have a trigger 50 on the front 54 of the handle 6 for activating or shooting the punch 22. The trigger 50 may have a different size or shape than is shown in the drawings. For example, the trigger 50 may be a lever, similar to a staple gun, or may look similar to a hand gun trigger. Other trigger shapes and sizes can be used in other embodiments. The rear side 58 of the handle may be curved to comfortably fit a user's hand. The right side 62 and left side (not shown in this figure) of the handle 6 may be substantially flat to comfortably fit a user's hand. In some embodiments, the handle 6 and/or trigger 50 has a texture to assist with gripping. In additional or alternative embodiments, the handle 6 and/or trigger 50 may have a rubber (or other gripping material) coating or outer layer to assist with gripping. The handle 6 and/or trigger 50 may also have cushioning for comfort.

Figure 2:
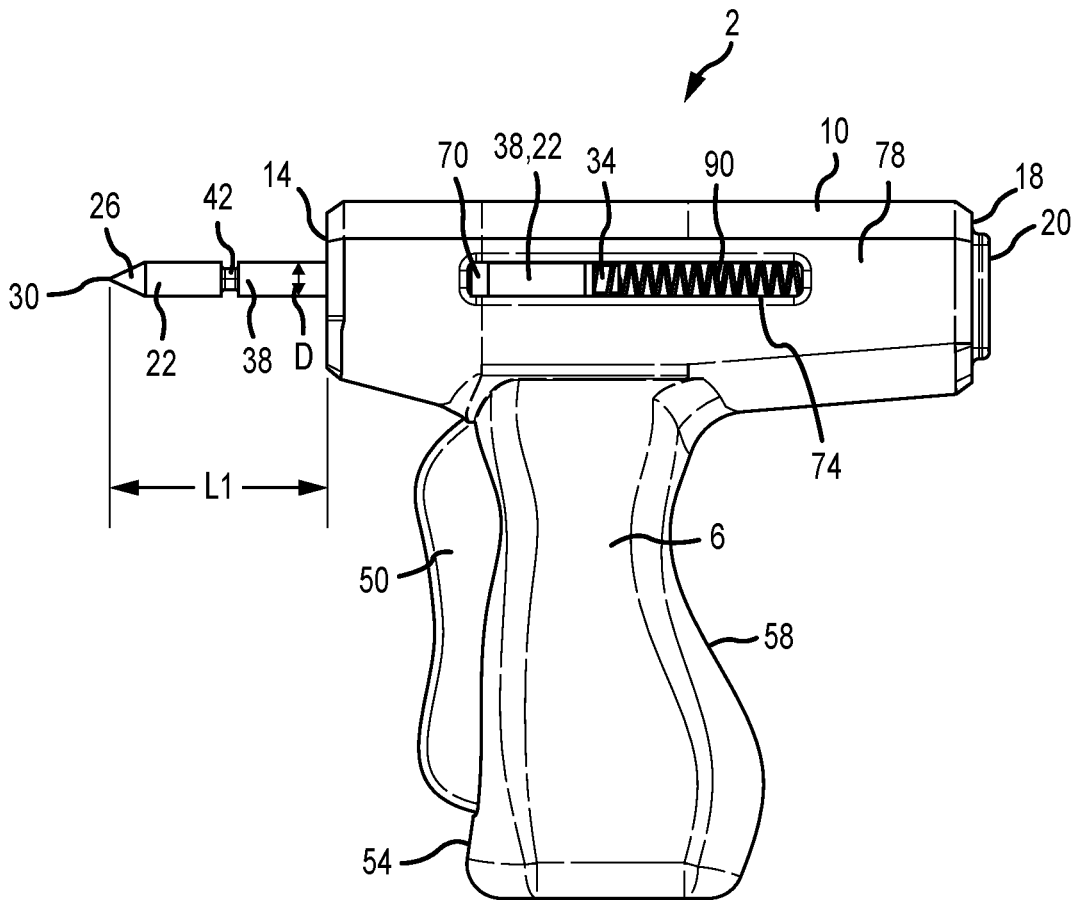
FIG. 2 is a right elevation view of embodiments of the device for creating a hole in the ground.

FIG. 2 illustrates embodiments of the device 2 for creating a hole in the ground for a golf tee and is a right elevation view of the device 2. The device 2 can have a tee extractor 20 on the rear end 18 in some embodiments. Here the racking lever 70 is all the way forward in the opening 74 of the head 10 and the punch 22 extends outwardly from the front 14 of the head 10 of the device 2. In this position, the punch 22 extends outward a maximum distance, L1. In some embodiments, the punch 22 extends outward from the front 14 of the head 10 a distance L1 between about 0.50 inches and about 2.5 inches. In a preferred embodiment, the punch 22 extends outward a distance L1 between about 1.0 inch and 2.0 inches. In a more preferred embodiment, the punch 22 extends outward a distance L1 between about 1.25 inches and 1.75 inches. In a more preferred embodiment, the punch 22 extends outward a distance L1 of about 1.50 inches. Also in this position, the spring 90 interconnected to the distal end 34 of the punch 22 can be seen through the opening 74, along with the cylindrical portion 38 of the punch 22.

The diameter D of the cylindrical portion 38 of the punch 22 can vary in various embodiments. In some embodiments, the diameter D of the cylindrical portion 38 of the punch 22 is between about 0.10 inch and about 0.25 inch. In a preferred embodiment, the diameter D of the cylindrical portion 38 of the punch 22 is between about 0.15 inch and about 0.20 inch. In a more preferred embodiment, the diameter D of the cylindrical portion 38 of the punch 22 is about 3/16 inch. The diameter of the indention 42 in the punch 22 is smaller than the diameter of the cylindrical portion 38 of the punch 22. For example, in some embodiments, the diameter of the indention 42 in the punch 22 is between about 0.05 inch and about 0.125 inch. In a preferred embodiment, the diameter of the indention 42 is between about 0.075 inch and about 0.10 inch. In a more preferred embodiment, the diameter of the indention 42 is about 3/32 inch.

Figure 3:
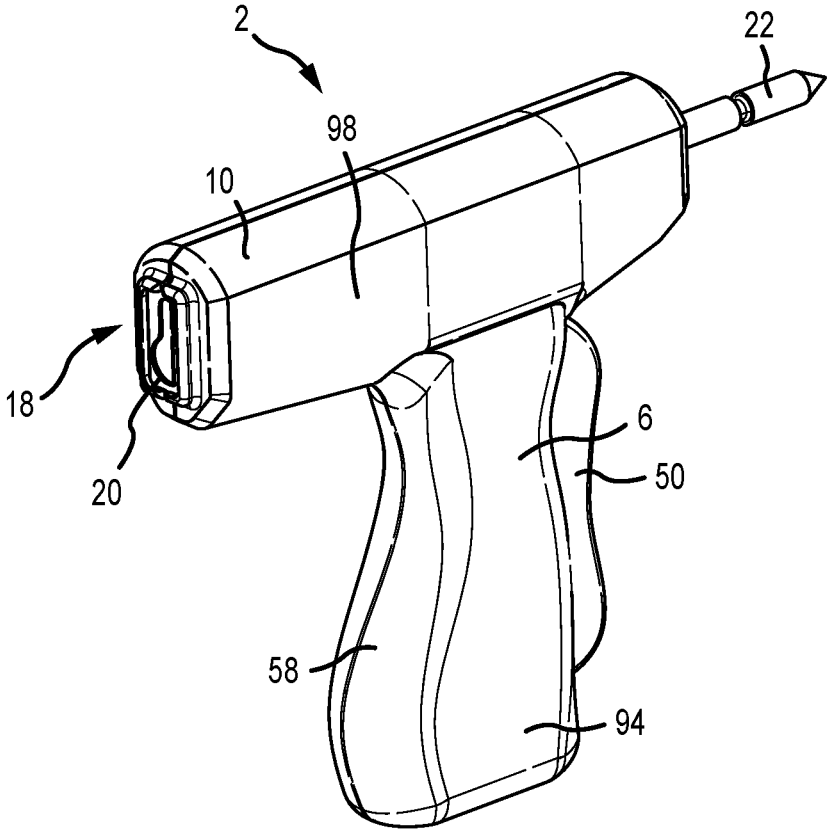
FIG. 3 is a left perspective view of embodiments of the device for creating a hole in the ground.

FIG. 3 illustrates embodiments of the device 2 and is a left rear perspective view of the device 2. Here the left side 98 of the head 10 can be seen along with the left side 94 of the handle 6. Moreover, the rear end 18 of the head 10 with the tee extractor 20 and rear side 58 of the handle 6 can be seen in this view. The tee extractor 20 has a raised outer-platform positioned a distance from the outer surface of the device 2, where the distance is large enough to accommodate a typical tee head. The raised platform has an aperture with a large round section on one end (sized such that it is larger than a typical tee head) and a smaller oval or straight section on the other end of the aperture. The aperture can be shaped similar to a keyhole slot. Because the platform is positioned a distance from the outer surface of the device, a tee head can fit between the platform and the outer surface. The tee extractor 20 functions by the user placing the head of the tee in the large round section of the aperture and moving the device such that the tee head slides along the oval or straight section and between the platform and outer surface of the device. The oval or straight section is sized such that it is smaller than a typical tee head. Thus, the tee head is held in the oval or straight section and the user can pull up on the tee to remove it from the ground using the tee extractor 20. In some embodiments, the tee extractor 20 has a different shape, for example, it may be similar to a claw on the end of a hammer or have rails running along the rear end 18 where the head of the tee is positioned between the claw or the rails by sliding the extractor 20 along the head of the tee such that the claw or rails hold the tee head and the user can pull the tee out of the ground.

Figure 4:
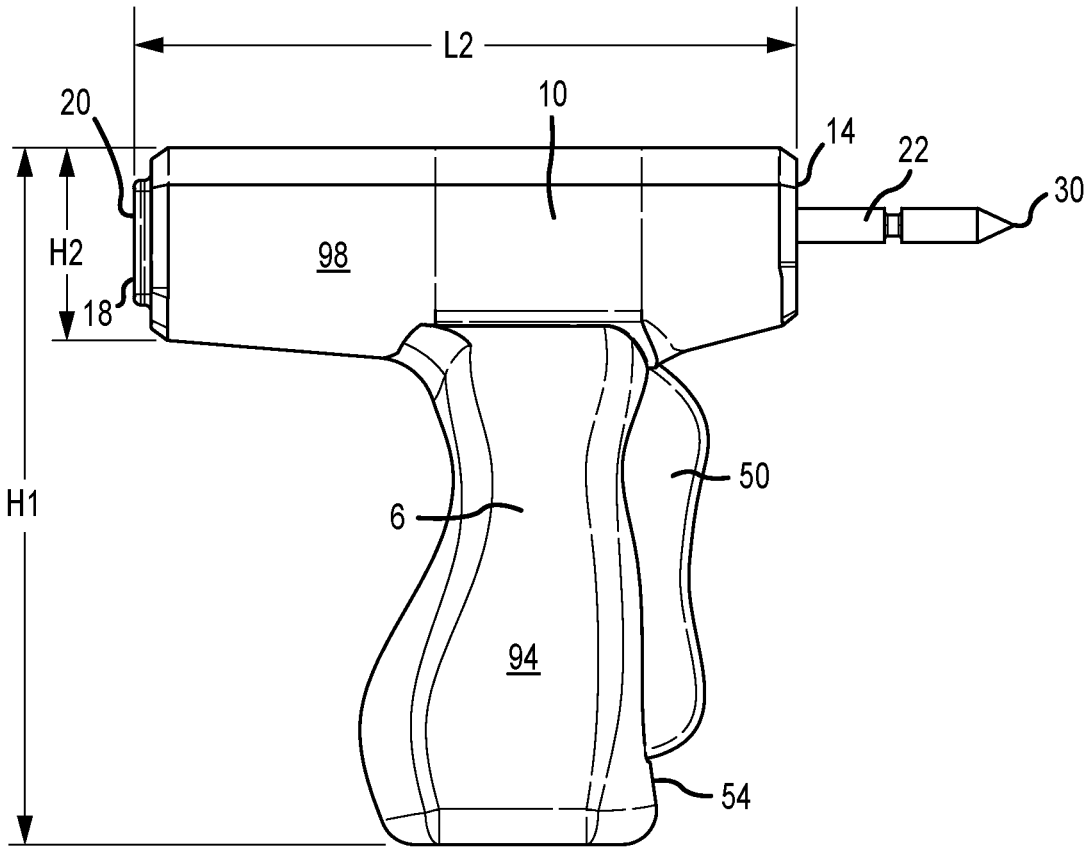
FIG. 4 is a left elevation view of embodiments of the device for creating a hole in the ground.

FIG. 4 illustrates embodiments of the device 2 and is a left elevation view of the device 2. The left side of the device 2 is similar to the right side of the device 2. In some embodiments, the height H1 of the device 2 is between about 3.0 inches and about 6.0 inches. In a preferred embodiment, the height H1 of the device 2 is between about 3.5 inches and about 5.0 inches. In a more preferred embodiment, the height H1 of the device 2 is between about 3.75 inches and about 4.5 inches. In a more preferred embodiment, the height H1 of the device 2 is about 4.0 inches. In some embodiments, the height H2 of the head 10 of the device 2 is between about 0.5 inches and about 2.0 inches. In a preferred embodiment, the height H2 of the head 10 of the device 2 is between about 0.75 inches and about 1.5 inches. In a more preferred embodiment, the height H2 of the head 10 of the device 2 is between about 1.0 inches and about 1.25 inches. In a more preferred embodiment, the height H2 of the head 10 of the device 2 is about 1.1 inches. In some embodiments, the length L2 of the head 10 of the device 2 is between about 2.5 inches and 5.0 inches. In a preferred embodiment, the length L2 of the head 10 of the device 2 is between about 3.0 inches and 4.5 inches. In a more preferred embodiment, the length L2 of the head 10 of the device 2 is between about 3.5 inches and 4.0 inches. In a more preferred embodiment, the length L2 of the head 10 of the device 2 is about 3.8 inches.

Figure 5:
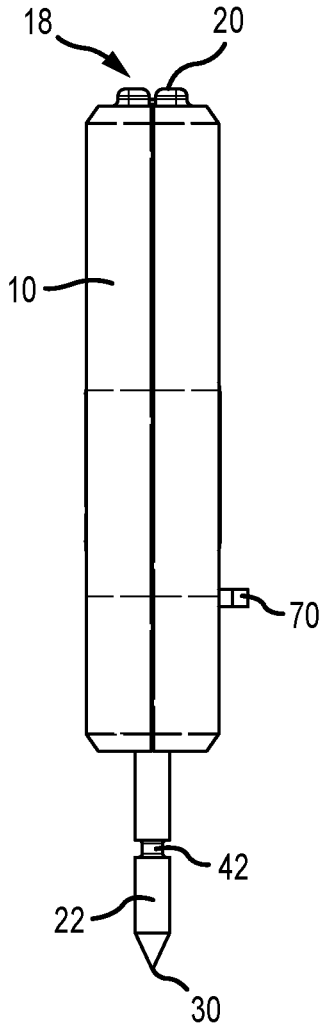
FIG. 5 is a top plan view of embodiments of the device for creating a hole in the ground.
Figure 6:
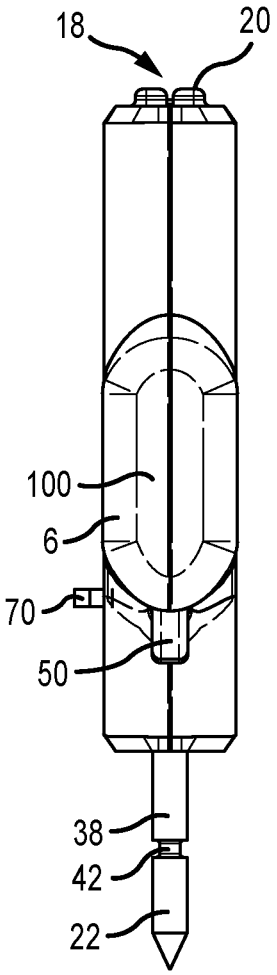
FIG. 6 is a bottom plan view of embodiments of the device for creating a hole in the ground.

FIG. 5 illustrates embodiments of the device 2 and is a top plan view of the device 2 and FIG. 6 is a bottom plan view of the device 2. The racking lever 70 extends outward from the right side 78 of the head 10 of the device 2. The racking lever 70 extends outward enough for a user to push on or pull the racking lever 70, as described in detail with FIGS. 9-16. The bottom 100 of the handle 6 can be flat or curved in various embodiments. In the embodiment show, the bottom 100 is substantially flat with rounded edges. In some embodiments, where there is an opening on both sides of the head, two racking levers 70 can be present.

Figure 7:
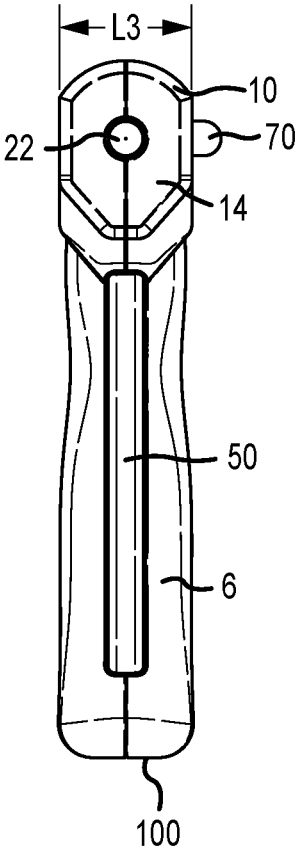
FIG. 7 is a front elevation view of embodiments of the device for creating a hole in the ground.
Figure 8:
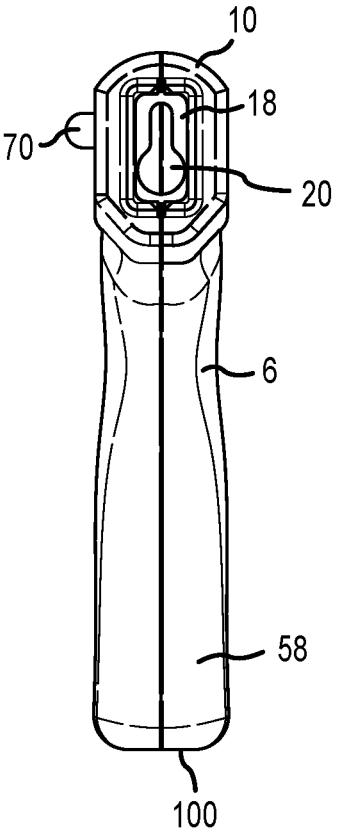
FIG. 8 is a rear elevation view of embodiments of the device for creating a hole in the ground.

FIG. 7 illustrates embodiments of the device 2 and is a front elevation view of the device 2 and FIG. 8 illustrates embodiments of the device 2 and is a rear elevation view of the device 2. In some embodiments, the length L3 of the head 10 of the device 2 is between about 0.4 inches and about 1.5 inches. In a preferred embodiment, the length L3 of the head 10 of the device 2 is between about 0.5 inches and about 1.25 inches. In a more preferred embodiment, the length L3 of the head 10 of the device 2 is between about 0.6 inches and about 1.0 inches. In a more preferred embodiment, the length L3 of the head 10 of the device 2 is about 0.75 inches.

Figure 9:
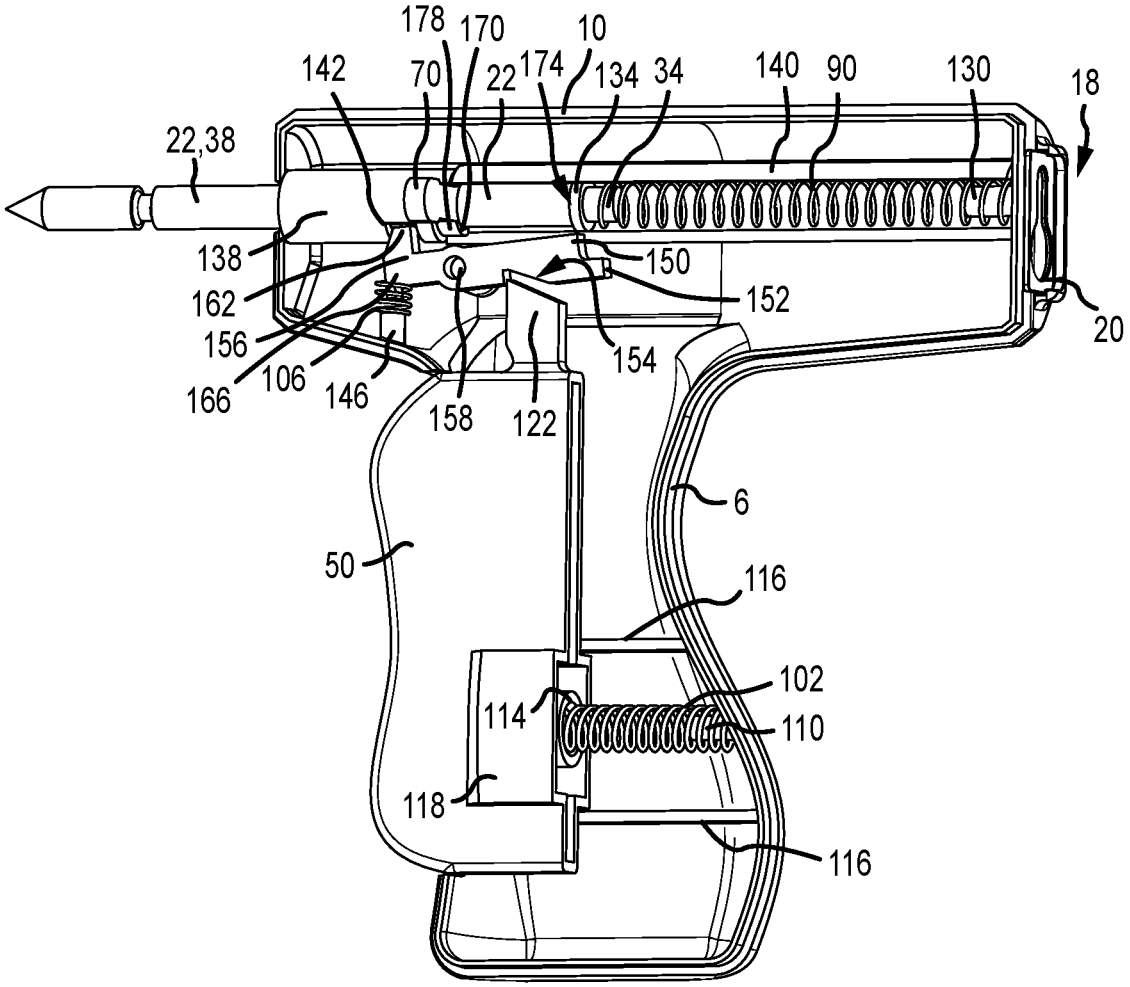
FIG. 9 is a right rear perspective sectional view of embodiments of the device for creating a hole in the ground showing the internal components of the device with the trigger in the resting position and the racking lever in the forward position.

FIG. 9 illustrates embodiments of the device 2 and is a right rear perspective sectional view of the device 2 showing internal components of the device 2 with the trigger 50 in the resting position and the racking lever 70 in the forward position. The punch 22 is in the forward-most position with the maximum amount of the punch 22 extending outward from the front of the head 10. The head 10 of the device 2 has a spring 90 interconnected to an inner surface of the rear end 18 of the head 10. Inside the head 10, the rear end 18 has a protrusion 130 that may act as a stop surface and/or the spring 90 may be interconnected to the protrusion 130 on one end of the spring 90. The other end of the spring 90 can be interconnected to the proximal end 34 of the punch 22. The proximal end 34 of the punch 22 may have a smaller diameter than the cylindrical portion 38. In some embodiments, proximal end 34 of the punch 22 can have the diameter as the cylindrical portion 38 or a larger diameter than the cylindrical portion 38. The protrusion 130 and proximal end 34 of the punch 22 may be cylindrical in shape such that the spring 90 can easily interconnect to these pieces without interfering with the function of the spring 90. In some embodiments, the spring 90 is not a cylindrical coil spring and the protrusion 130 and proximal end 34 of punch 22 can have different shapes. The spring 90 is in its resting position in FIG. 9. The purpose of the spring 90 is to push the punch 22 forward and out of the head 10 of the device 2. This happens by the punch 22 being pulled into the head 10 and compressing the spring 90. Thus, the force from the compressed spring 90 pushes the punch 22 out of the head 10 and into the ground.

Figure 10:
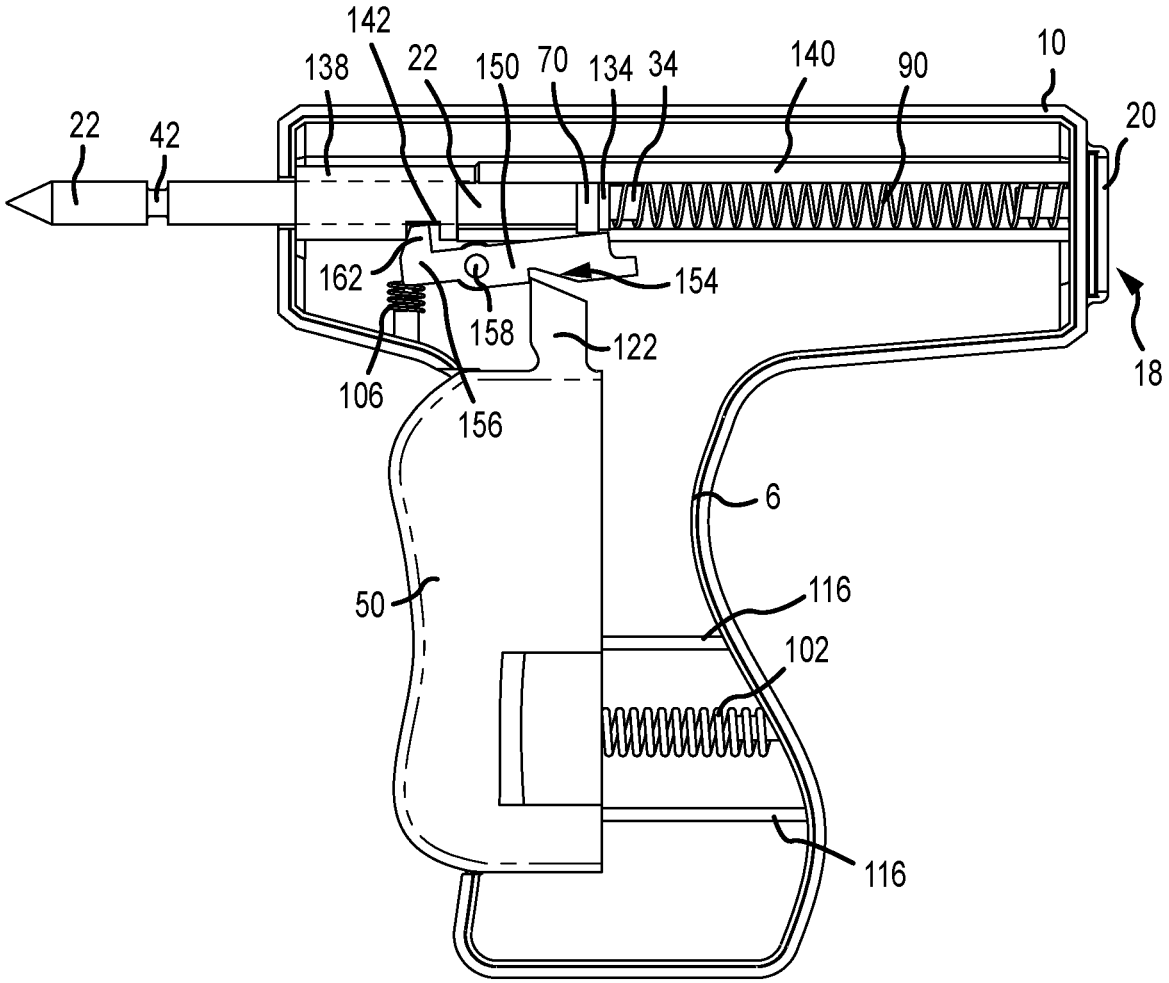
FIG. 10 is a right sectional view of embodiments of the device for creating a hole in the ground with the trigger in the resting position and the racking lever partially pulled back.

The proximal end 34 of the punch 22 includes a stop ring 134 with an outer diameter that is greater than the diameter of the cylindrical portion 38 of the punch 22. The stop ring 134 may be formed in the punch 22 such that they are one piece and are the same material. Alternatively, the stop ring 134 may be a separate piece that is secured to the proximal end 34 of the punch 22. In other embodiments, the proximal end 34 of the punch 22 may have one or more outwardly extending portions (e.g., flanges, protrusions, bumps, protuberances, etc.) that act like a stop surface rather than having a stop ring 134. The racking lever 70 has a proximal end 178 opposite the distal end of the lever 70, where the user interacts with the distal end of the racking lever 70. The distal end of the racking lever 70 can have flat sides and a rounded end, as shown. Alternatively, the distal end of the racking lever 70 can have rounded or curved sides, a rounded end, a flat end, or any combination thereof. The proximal end 178 has an aperture with a diameter slightly larger than the diameter of the cylindrical portion 38 of the punch 22 such that the punch 22 is positioned in the aperture and the proximal end 178 can slide along the punch 22. The racking lever 70 may also be able to rotate around the punch 22. Thus, the racking lever 70 is interconnected to the punch 22 because its aperture is positioned around the cylindrical portion 38 of the punch 22. The racking lever 70 can slide along the punch 22 until it hits the stop ring 134 (FIG. 10). The stop ring 134 has a forward surface 174 that engages a rear surface 170 of the proximal end 178 of the racking lever 70 (as shown in FIG. 10). In some embodiments, the forward surface 174 of the stop ring 134 and the rear surface 170 of the proximal end 178 of the racking lever 70 are substantially flat such that they can be positioned adjacent one another with the maximum amount of surface area touching each other. Alternatively, one surface 170, 174 can have a concave or curved shape while the other surface 170, 174 has a convex or curved shape, where the two shapes fit together. In some embodiments, the racking lever 70 is formed with the punch 22 such that they are one piece or is secured to the punch 22 such that it cannot move relative to the punch 22. Thus, the racking lever 70 would not slide along the punch 22 and, rather, would pull the punch 22 with any movement of the racking lever 70.

The head 10 of the device 2 can have a punch housing 138 positioned around a portion of the punch 22. In some embodiments, the punch housing 138 is positioned inside the head 10 and proximate the front end 14. The punch housing 138 is cylindrical and has an inner diameter that is larger than the punch diameter D. Thus, the punch housing 138 keeps the punch 22 centered and in the correct position in the device 2. The punch housing 138 holds the punch 22 in the proper position. The punch housing 138 also has a cutout 142 for the nose 162 of the head 156 of the locking lever 150. The cutout 142 is sized, shaped, and positioned to receive the nose 162 of the locking lever 150 without interfering with the function of the locking lever 150 and nose 162. Thus, it is preferred that the cutout 142 is larger than the nose 162 such that the cutout 142 does not touch the nose 162 as the nose 162 slides along the punch 22 and as it moves in and out of the indention 42 on the punch 22. In some embodiments, rather than have a cutout 142 for the nose 162, the punch housing 138 ends where the cutout 142 would begin, i.e., on the left of the cutout 142 as shown in FIG. 9.

The device 2 can have a spring housing 140 inside the head 10 in some embodiments. The spring housing 140 can extend from the rear end 18 of the head 10 to the rear end of the punch housing 138. The spring housing 140 can be interconnected to the punch housing 138 or the spring housing 140 and punch housing 138 can be one piece in some embodiments. In various embodiments, the spring housing 140 may not extend all the way to the punch housing 138. The spring housing 140 may have a different inner diameter than the punch housing 138 since the punch housing 138 is sized for the cylindrical portion 38 of the punch 22 and the spring housing 140 is sized for the horizontal spring 90, stop ring 134, and/or distal end 178 of the racking lever 70. In some embodiments, the punch housing 138 and spring housing 140 have the same inner diameter. The spring housing 140 may not extend around the entire circumference of the spring 90 (i.e., it may not extend the full 360° around the spring). For example, the spring housing 140 may extend around the spring 90 between about 180° and about 300°. If the spring housing 140 extends around the spring 90 the entire circumference (360°), then the spring housing 140 must have a cutout to permit the racking lever 70 to move rearward with the punch 22. Thus, some embodiments include a spring housing 140 that extends around the spring 90 the entire circumference (360°) and the spring housing 140 has a cutout for the racking lever 70.

The locking lever 150 has a head 156 opposite a tail 152. The locking lever 150 rotates around a pivot point 158, which may be a pin, rivet, screw, stud, or other mechanism. The head 156 is positioned on one side of the pivot point 158 and the tail 152 is positioned on the opposite side of the pivot point 158. The tail 152 can have an L-shape as shown, or have a flat end, rounded end, angled end, or any other shaped end that functions with the device 2. The tail 152 should be shaped and sized (including the length of the locking lever 150, especially the length extending rearward of the pivot point 158) such that it does not interfere with the punch 22, stop ring 134, spring 90, or distal end 178 of the racking lever 70, unless such interference is desired for the specific embodiment. The head 156 of the locking lever 150 can have a nose 162 opposite a butt 166. The nose 162 interacts with the punch 22 and at least a portion of the nose 162 is positioned in the cutout 142 of the punch housing 138. The butt 166 interacts with a spring 106. The spring 106 is interconnected to or positioned around the butt 166 of the head 156 and pushes the butt 166 (and, thus, the head 156 and nose 162) upward toward the punch 22. The spring 106 ensures that the nose 162 is constantly in contact with the punch 22. The opposite end of the spring 106 is interconnected to or positioned around a protrusion 146 or other interconnection point on the inside of the head 10 of the device 2. The protrusion 146 may have a cylindrical shape or may be square or rectangular shaped. The protrusion 146 extends upward from an inner surface of the head 10 of the device 2. A bottom surface of the tail 152 of the locking lever 150 has a cutout 154 sized and shaped to receive a flange 122 extending from a top/upper inner surface of the trigger 50. Both the flange 122 and cutout 154 can have a sloped or slanted surface and these two surfaces can engage and interact with one another. In some embodiments, the cutout 154 and the flange 122 are shaped differently than shown, for example, the cutout 154 and flange 122 can be rounded, more square shaped, etc. Additionally, the cutout 154 may not be shaped exactly like the flange 122. Rather, the cutout 154 and the flange 122 can have different shapes that interact with one another, as desired in the specific embodiment.

The handle 6 of the device comprises a spring 102 interconnected on one end to an inner rear surface of the handle 6. The interconnection point may include a protrusion 110 such that the spring 102 is positioned around and/or interconnected to the protrusion 110. The protrusion 110 may have a cylindrical shape or may be square or rectangular shaped. The protrusion 110 extends outward from an inner rear surface of the handle 6 of the device 2. The opposite end of the spring 102 is interconnected to the trigger 50 via an interconnection mechanism or spring holder 114. The spring holder 114 can be a cylindrical piece with an inner diameter that is larger than the outer diameter of the spring 102 such that the spring 102 fits in the spring holder 114. In some embodiments, the spring holder 114 may be a protrusion (similar to items 110 and 130) or any other known mechanism used to hold, secure, and/or interconnect to one end of the spring 102. The spring holder 114 provides a place for the spring 102 to interconnect to the trigger 50 and keeps the spring 102 in the proper position and prevents the spring 102 from twisting. The handle 50 also has tracks 116 and a rider 118 for sliding along the tracks 116. The rider 118 can be positioned around the spring holder 114 or located above or below the spring holder 114. In some embodiments, the rider 118 has a square or rectangular shape. Thus, the rider 118 is positioned between two tracks 116 and slides along the tracks 116 as the trigger 50 is pulled and released. In some embodiments, the tracks 116 are positioned on an inner surface of the left side 94 of the handle 50. In some embodiments, the tracks 116 are positioned on an inner surface of the right side 62 of the handle 50. In some embodiments, the tracks 116 are positioned on the inner surfaces of both the right side 62 and the left side 94 of the handle 50. The tracks 116 can extend across the entire width of the handle 50 or only a portion of the handle width. Further, the size of the rider 118 and the tracks 116 can vary in various embodiments. For example, the tracks 116 may be wider (i.e., extend farther from the inner wall(s)) and the rider 118 may be slimmer (i.e., extend a shorter distance away from the trigger's vertical centerline and spring 102. The tracks 116 and rider 118 prevent the trigger 50 and trigger spring 102 from twisting or moving in a non-linear direction. Thus, the tracks 116 and rider 118 ensure that the trigger 50 and trigger spring 102 stay straight and move in a horizontal direction.

Figure 14:
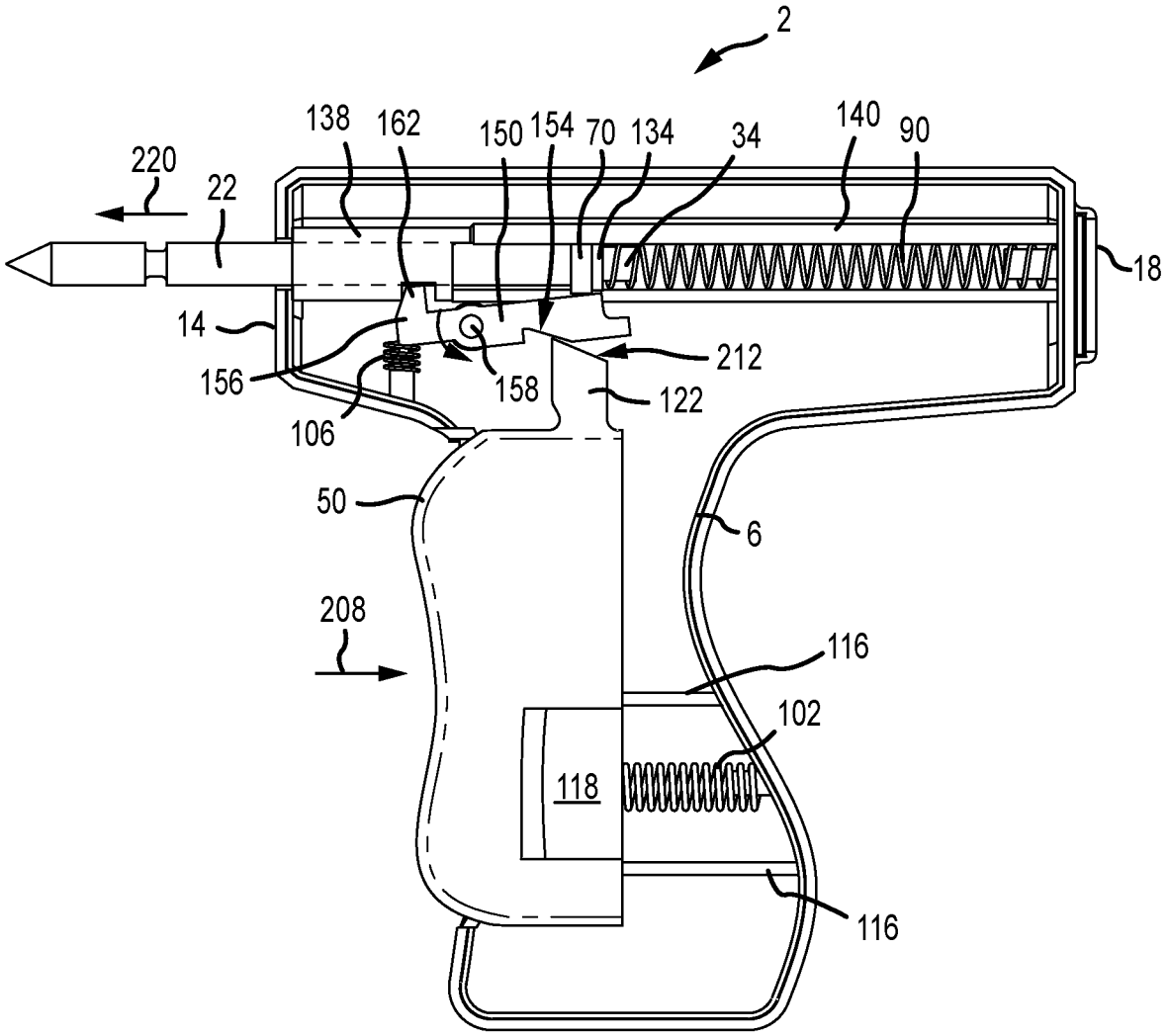
FIG. 14 is a right sectional view of embodiments of the device for creating a hole in the ground with the trigger fully depressed and the punch shooting forward.

The spring 102 is in the resting position in FIG. 9. When the trigger 50 is compressed (i.e., moved to the right of FIG. 9, as shown in FIG. 14), the spring 102 is also compressed. Thus, the compressed spring 102 wants to push the trigger 50 back to the trigger's resting position. The tracks 116 and rider 118 ensure that the trigger 50 moves in a straight direction when returning to its resting position.

FIG. 10 illustrates embodiments of the device 2 and is a right sectional view of the device 2 with the trigger 50 in the resting position and the racking lever 70 pulled back to the stop ring 134. The inner components of the device 2 are visible in FIG. 10. Here, the racking lever 70 has been pulled backward and slid along the punch 22. At this point, the forward surface 174 of the stop ring 134 engages the rear surface 170 of the proximal end 178 of the racking lever 70. Thus, the forward surface 174 of the stop ring 134 is touching the rear surface 170 of the proximal end 178 of the racking lever 70. The punch 22 has not yet moved at this point, only the racking lever 70 has moved along the punch 22. The locking lever 150 is slightly rotated around the pivot point 158 counterclockwise as the end of the nose 162 of the head 156 slides along the outer surface of the punch 22. As the racking lever 70 is pushed back toward the rear end 18 of the head 10 beyond the point shown in FIG. 10, the racking lever 70 will engage the stop ring 134 and pull the punch 22 back toward the rear end 18 of the head 10 and compress the spring 90.

Figure 11:
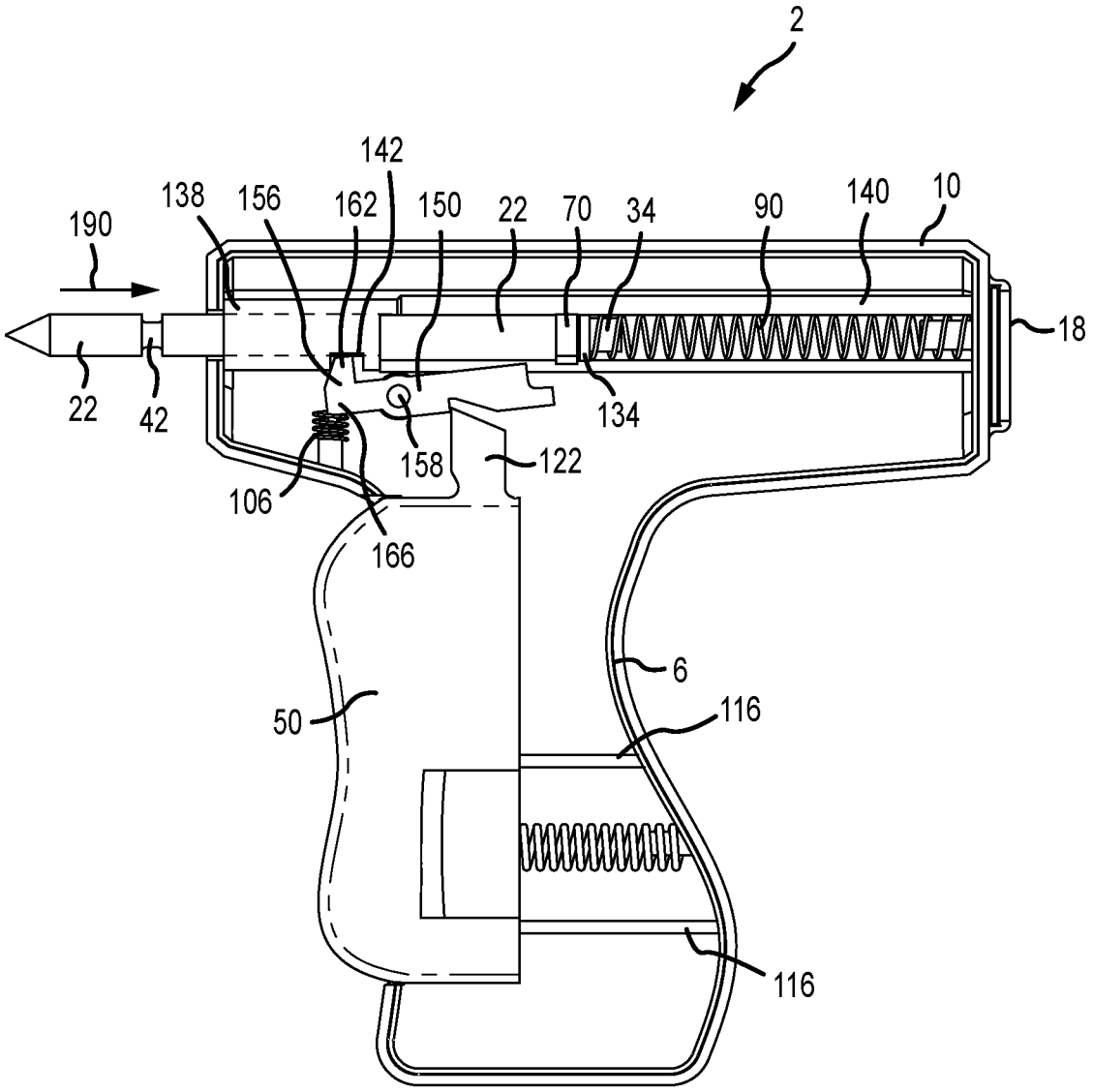
FIG. 11 is a right sectional view of embodiments of the device for creating a hole in the ground with the trigger in the resting position and the racking lever and punch pulled partially back.

FIG. 11 illustrates embodiments of the device 2 and is a right sectional view of the device 2 with the trigger 50 in the resting position and the racking lever 70 pulled back farther toward the rear end 18 of the head 10. As the racking lever 70 is pulled farther back toward the rear end 18, the punch 22 is also pulled back toward the rear end 18. More specifically, the proximal end 178 of the racking lever 70 is pulling the stop ring 134, which is interconnected to the punch 22 and, thus, the punch 22 is pulled toward the rear end 18. Arrow 190 shows the direction the punch 22 is moving. At this point, a smaller amount of the punch 22 is positioned outside of the head 10 of the device 2 than the amount in FIGS. 9 and 10. Thus, more of the punch 22 is positioned within the head 10 at this point in time than in FIGS. 9 and 10. The locking lever 150 is still rotated slightly counter-clockwise, as it was in FIG. 10, because the nose 162 of the head 156 is still sliding along the outer surface of the punch 22. The butt 166 of the head 156 of the locking lever 150 compresses the vertical spring 106 downward such that the vertical spring 106 is exerting a force on the head 156 and is pushing the nose 162 against the outer surface of the punch 22. The horizontal spring 90 in the head 10 is more compressed as the proximal end 34 of the punch 22 pushes the spring 90 toward the rear end 18 of the head 10 of the device 2.

Figure 12:
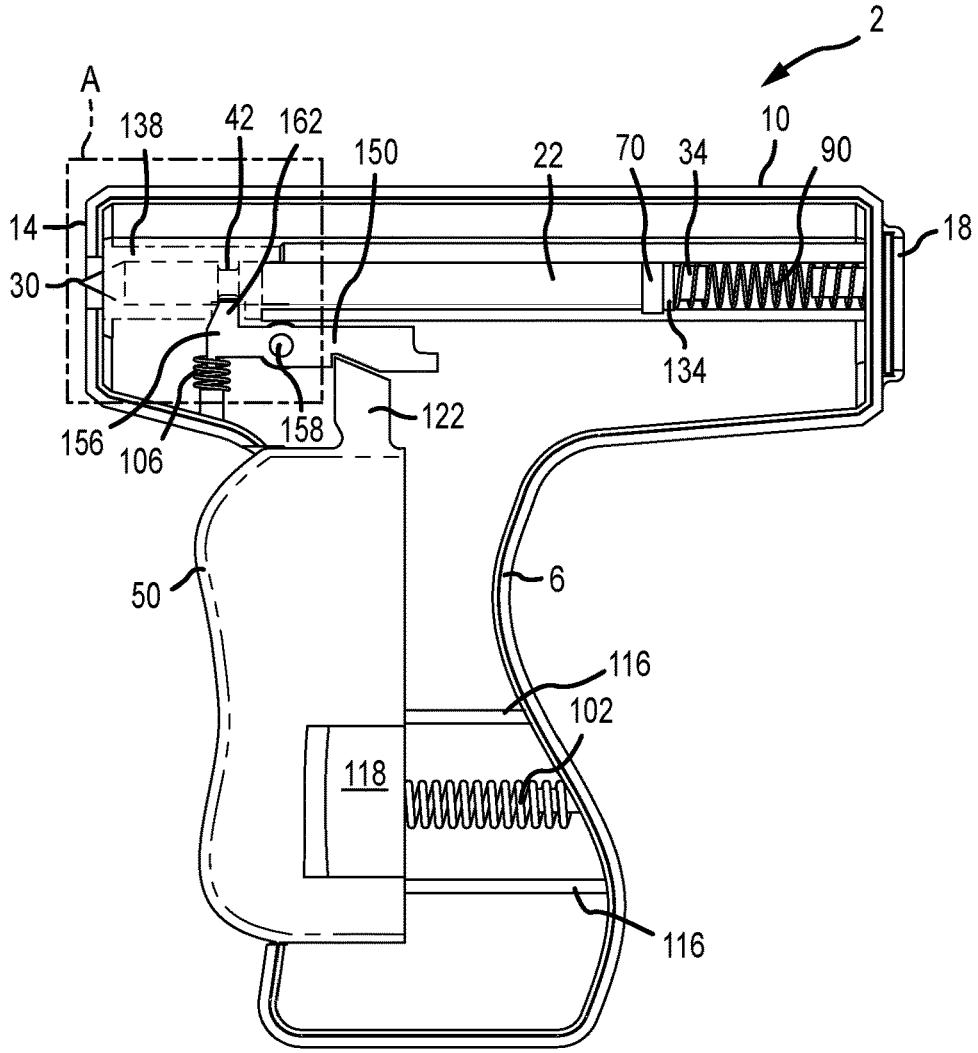
FIG. 12 is a right sectional view of embodiments of the device for creating a hole in the ground with the trigger in the resting position and the racking lever pulled all the way back.

FIG. 12 illustrates embodiments of the device 2 and is a right sectional view of the device 2 with the trigger 50 in the resting position and the racking lever 70 pulled all the way back to the rear end of the opening (74 in other figures). The racking lever 70 cannot move any farther to the rear end 18 of the head 10 of the device 2 than is shown in FIG. 12 because it is limited by the cutout 74 length. Further, the punch 22 cannot move any farther to the rear end 18 of the head 10 of the device 2 since the racking lever 70 moves the punch 22 and the racking lever 70 cannot move any farther to the rear end 18. The horizontal spring 90 in the head 10 is compressed and exerting a forward-oriented force on the punch 22. The punch 22 is held in this "loaded" position because the nose 162 of the locking lever 150 is positioned in the indention 42 of the punch 22 and prevents the punch 22 from sliding forward. Specifically, as the racking lever 70 is pulled toward the rear end 18, the nose 162 of the locking lever 150 slides along the outer surface of the punch 22. When the nose 162 reaches the indention 42, the locking lever 150 rotates clockwise around the pivot point 158 as the nose 162 is pushed up into the indention 42 via the vertical spring 106. Almost the entire punch 22 is positioned within the device head 10 at this point. In some embodiments, the entire punch 22 may be positioned within the device head 10 when the device 2 is in the "loaded" position.

Figure 12A:
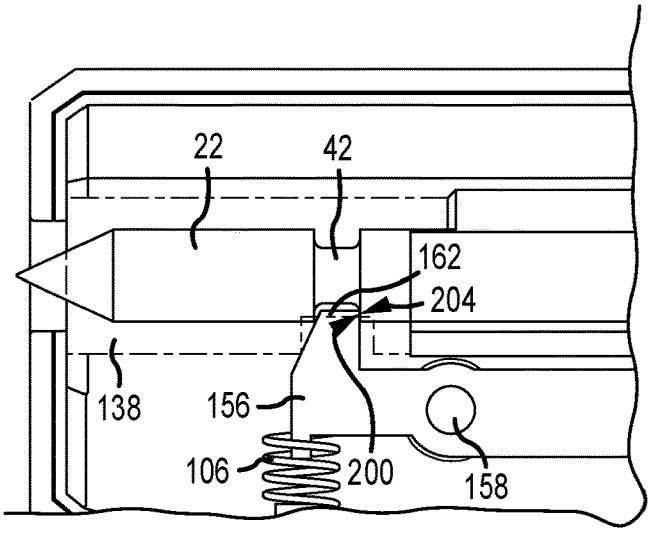
FIG. 12A is an enlarged view of detail A of FIG. 12.

FIG. 12A is an enlarged view of detail A of FIG. 12 with the punch housing 138 removed. Here, the nose 162 of the locking lever 150 is visible and positioned within the indention 42 of the punch 22. A substantially flat bottom surface 200 of the nose 162 engages and is positioned on a substantially flat upper surface 204 of the indention 42. In this position, the punch 22 is locked or secured in the "loaded" position. At this point, the user would position the front 14 of the head 10 on the ground where he or she would like the tee hole to be punched. Then the punch 22 will create a hole in the ground as the punch 22 is pushed out of the head 10 of the device 2 upon activation by the trigger 50.

Figure 13:
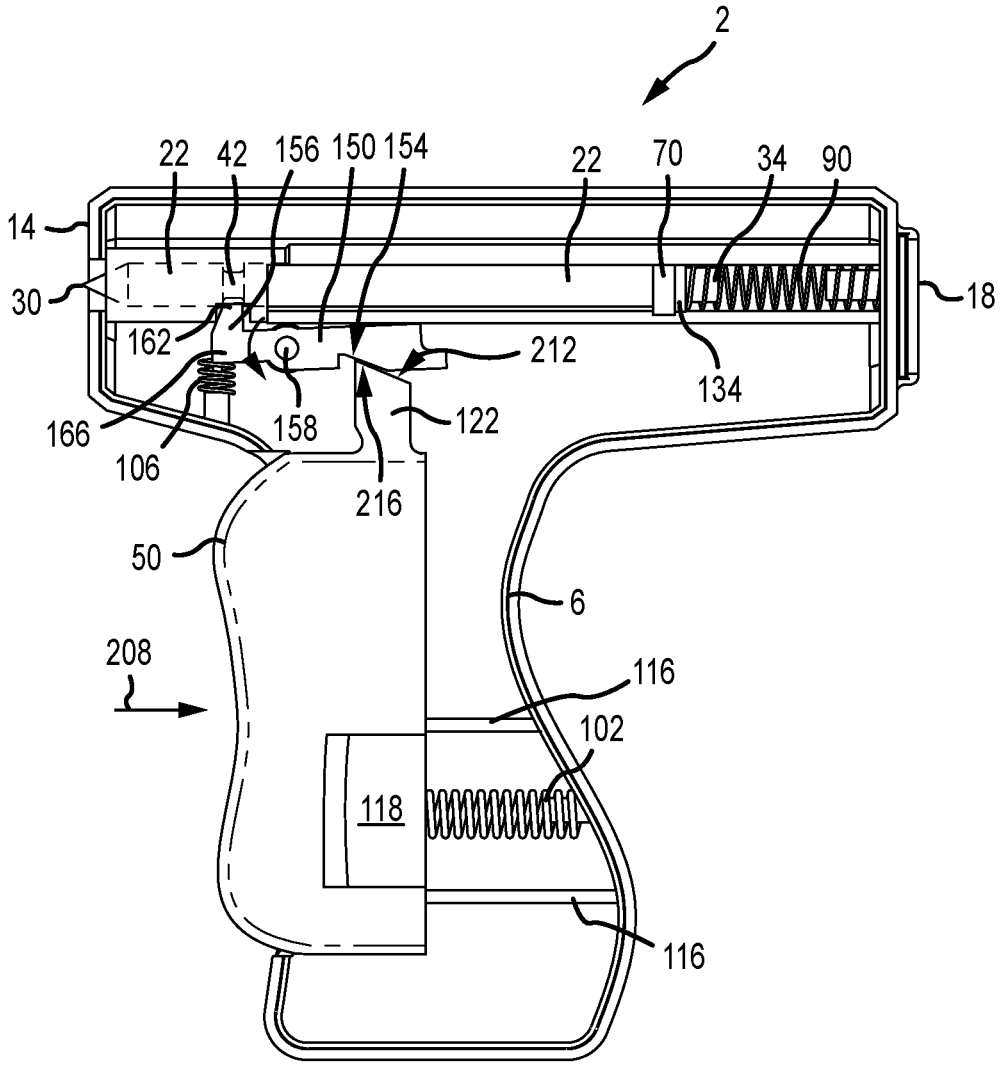
FIG. 13 is a right sectional view of embodiments of the device for creating a hole in the ground with the trigger halfway depressed.

FIG. 13 illustrates embodiments of the device 2 and is a right sectional view of the device 2 with the racking lever 70 pulled all the way back to the rear end of the opening (74 in other figures) and the trigger 50 partially depressed. The punch 22 and racking lever 70 are in the same position as is shown in FIG. 12. However, here, the trigger 50 is partially depressed in the direction of the arrow 208. As the trigger 50 is depressed, the horizontal handle spring 102 is compressed. As the trigger 50 is pulled or pushed to the right of FIG. 13, the flange 122 extending from a top inner surface of the trigger 50 also moves to the right. The upper surface 212 of the flange 122 is sloped and shaped to fit in the sloping cutout 154 in the locking lever 150. As the flange 122 moves to the right, the taller portion 216 of the sloping upper surface 212 pushes on a bottom surface of the locking lever 150, causing the locking lever 150 to rotate counter-clockwise around the pivot point 158 in the direction of the rotational arrow. As the locking lever 150 rotates, the butt 166 of the head 156 of the locking lever 150 moves downward and compresses the vertical spring 106. As the user continues to depress the trigger 50 in the direction of arrow 208, the flange 122 moves farther to the right and further rotates the locking lever 150. As the locking lever 150 rotates counterclockwise around the pivot point 158, the nose 166 will eventually slide off of or out of the indention 42 in the punch 22. At this point, the punch 22 is released and able to propel forward from the force of the compressed horizontal spring 90.

It is at this point in time that FIG. 14 is shown. Here, the punch 22 is being shot forward and out of the front 14 of the head 10 of the device 2. The trigger 50 is fully depressed in the direction of arrow 208. The force of the horizontal spring 90 propels the punch 22 out of the head 10 of the device 2. The springs 90, 102, 106 move the components back to their original resting positions, shown in FIG. 9. Specifically, the horizontal spring 102 in the handle 6 pushes the trigger to the left of FIG. 14 and back to the resting position where the flange 122 can slide back into the cutout 154 of the locking lever 150. The horizontal spring 90 in the head 10 pushes the punch 22 and the racking lever 70 to the left of FIG. 14 and back to the resting positions shown in FIG. 9. The racking lever 70 will slide with the punch 22 as the spring 90 pushes the punch 22 to the forward end of the head 10. The vertical spring 106 pushes the head 156 of the locking lever 150 upward and back to the resting position against an outer surface of the punch 22.

Figure 15:
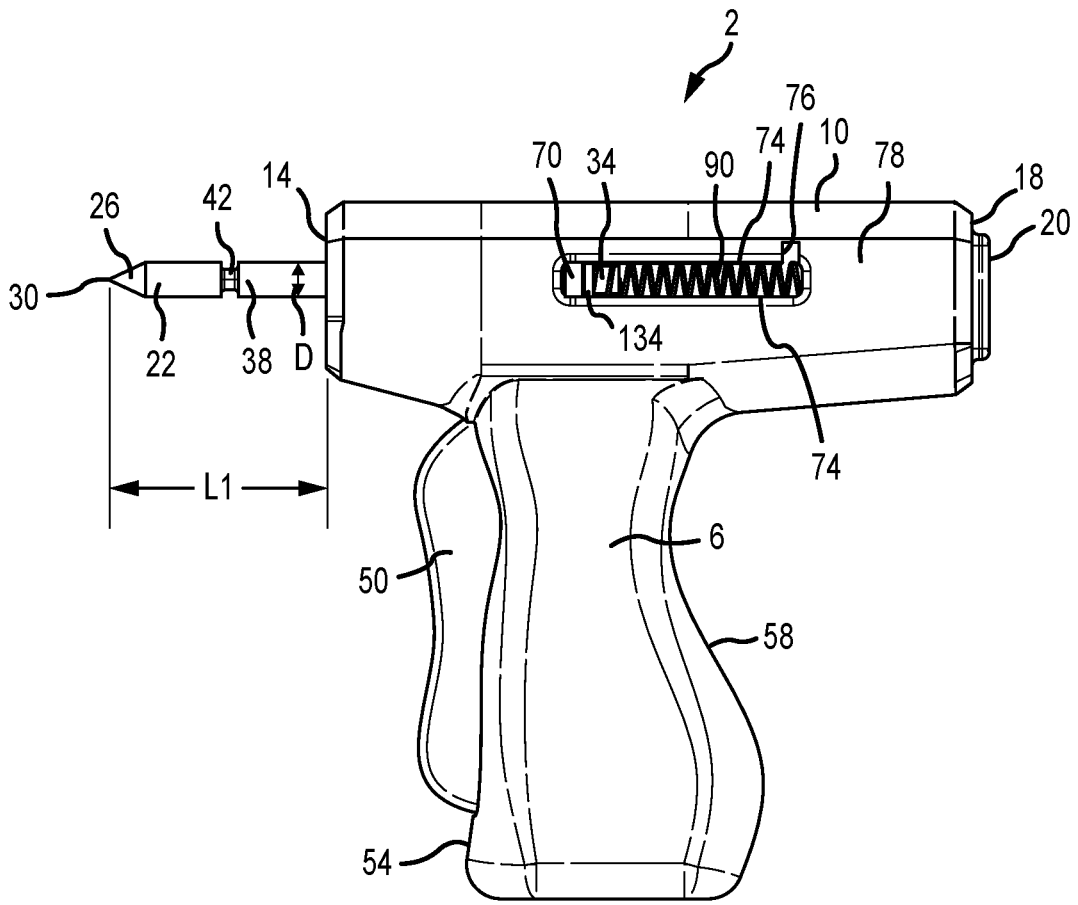
FIG. 15 is a right elevation view of embodiments of the device for creating a hole in the ground.
Figure 16:
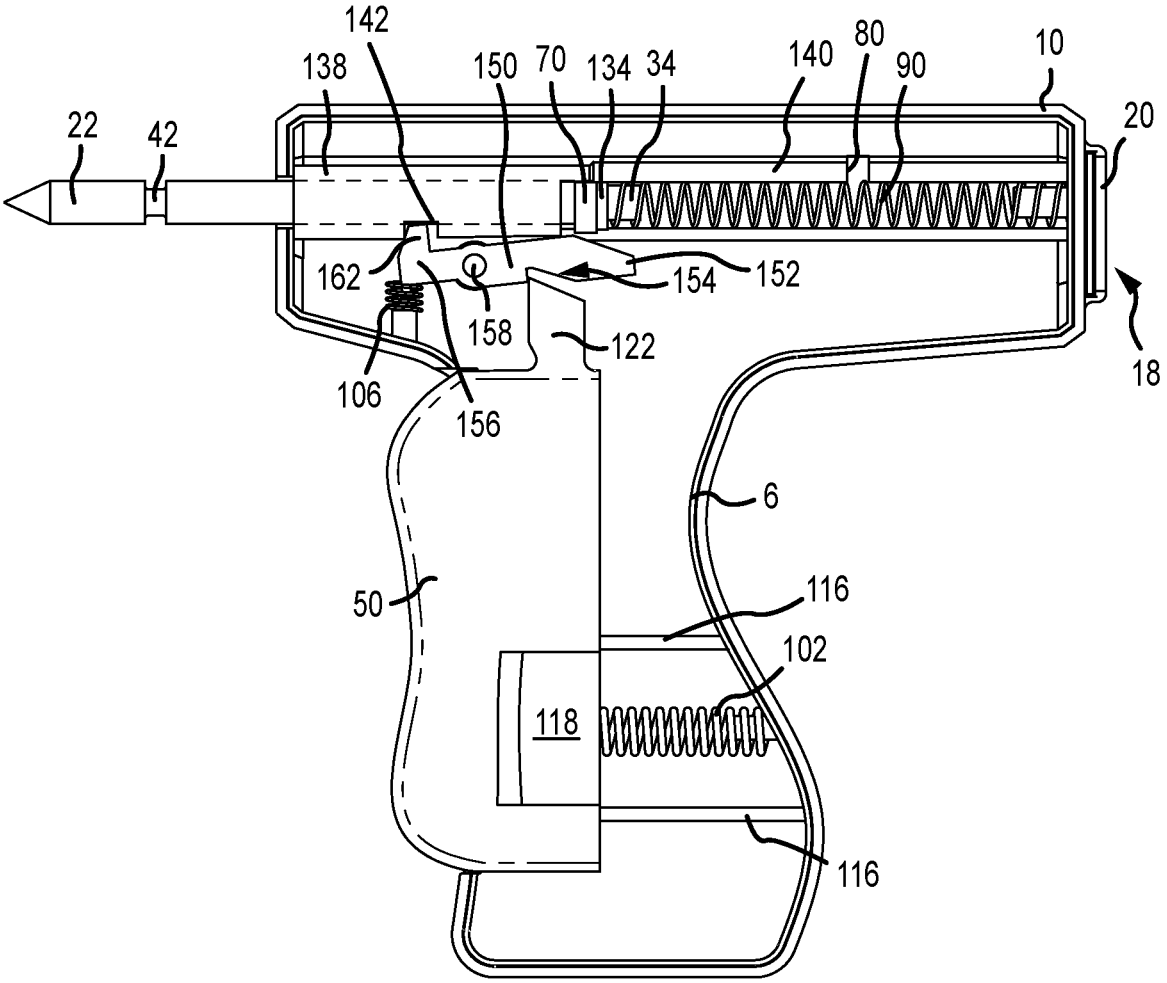
FIG. 16 is a right sectional view of embodiments of the device for creating a hole in the ground with the trigger in the resting position and the racking lever partially pulled back.

FIGS. 15 and 16 illustrate optional features that can be combined with any of the embodiments described herein. Specifically, FIGS. 15 and 16 show a shorter cutout 74 in the side 78 of the head 10 for the racking lever 70. Here, the racking lever 70 is positioned directly adjacent to the stop ring 134. Thus, the racking lever 70 cannot slide forward along the cylindrical portion 38 of the punch 22. Additionally, the horizontal cutout 74 can include an additional safety cutout 76 proximate the rear end of the horizontal cutout 74. The safety cutout 76 assists in preventing accidental firing of the punch 22. After the user pulls the racking lever 70 back to the rear end of the horizontal cutout 74, the nose of the locking lever engages the indention in the punch (not shown in this view, but shown in FIG. 12). At this point, the user can rotate the racking lever 70 upward and into the safety cutout 76. Even if the user accidentally pulls the trigger 50 when the racking lever 70 is positioned in the safety cutout 76, the punch 22 will not fire because the punch 22 is held in the "loaded" rearward position via the racking lever 70 positioned in the safety cutout 76. Thus, even when the nose of the locking lever is removed from the indention in the punch 22, the punch 22 stays in the rearward "loaded" position because it is held in that position by the racking lever 70 being held in the safety cutout 76.

In some embodiments, the racking lever 70 is one piece with the punch 22 and may even be formed of the same material as the punch 22. In these embodiments, a stop ring 134 may not be needed, as the racking lever 70 pulls the punch 22 since it is permanently attached or fixed to the punch 22. Thus, when the user rotates the racking lever 70 into the safety cutout 76, the entire punch 22 rotates with the racking lever 70. The system functions because the indention 42 in the punch 22 can go all the way around the punch 22 (360°), which means the nose of the locking lever can remain in the indention 42 even as the punch 22 is rotated with the racking lever 70. In some embodiments, the racking lever 70 is a separate piece (as described above with other figures) and can rotate around the punch 22. If the racking lever 70 is a separate piece and the cylindrical portion 38 of the punch 22 is positioned in an aperture of the racking lever 70, then only the racking lever 70 will rotate up and into the safety cutout 76. The entire punch 22 will not rotate with the racking lever 70.

For the features described in connection with FIG. 15 to function, some modifications must be made to the internal components of the device 2. See FIG. 16. Specifically, if the device 2 has a safety cutout 76 at the rear end of the horizontal cutout 74, then the spring housing 140 will need a matching safety cutout 80. The interior safety cutout 80 in the spring housing 140 needs to be aligned with the outer safety cutout 76 and needs to be either the same size and shape as the outer safety cutout 76 or at least larger than the racking lever 70. Further, because the outer horizontal cutout 74 is shorter in FIG. 15 than FIGS. 1 and 2, the punch housing 138 can be longer and extend approximately to the forward end of the horizontal cutout 74 or extend to anywhere between the racking lever 70 in the forward position and the nose 162 of the locking lever 150. This longer punch housing 138 can provide additional support and stability for the punch 22.

FIG. 16 also shows another optional feature or modification that can be included in any of the embodiments described herein. Here, the tail 152 of the locking lever 150 has an angled shape rather than the L-shape shown in other figures. The tail 152 can have any shape as long as it does not interfere with the punch 22, stop ring 134 (if the embodiment has a stop ring), or the locking lever 70, if such interference is not desired.

Although the figures show a device 2 with a handle 6, the device 2 does not have to have a handle 6. Rather, the racking lever 70 could also be the trigger mechanism such that when the user pulls the racking lever 70 to the rear end 18 of the device 2, the user could let go of the racking lever 70 to shoot the punch 22. The racking lever 70 is interconnected to and/or pulls the punch 22 to the rear end 18 of the device. In some embodiments, the user may pull the racking lever 70 to the rear end 18 of the device 2 and rotate the racking lever 70 into a safety cutout 76 to prevent the device 2 from firing. Then, when the user wants to fire the punch 22, the user merely rotates the racking lever 70 out of the safety cutout 76 and the force from an internal compressed spring 90 or other mechanism (e.g., pneumatic, magnetic) propels the punch 22 out of the device 2.

In some embodiments, the outer body portion comprising the head and the handle may be a hard plastic, composite material, metal, wood, or combinations thereof. Preferably, the material is durable, easily cleaned, and lightweight. However, various embodiments may use less durable materials or heavier materials depending on the desired use, quality, and weight. Further, the outer surfaces may be smooth, textured, or combinations thereof. The trigger may be the same material as the handle or a different material. As discussed above, the trigger and/or handle can have cushioning or coatings to assist in gripping and/or to increase comfort. The punch can be a hard plastic, composite material, metal, wood, or combinations thereof. Preferably, the punch is metal and is one piece. The punch may be hollow or solid. The internal components, for example the flange on the trigger and locking lever can be a hard plastic, composite material, metal, wood, or combinations thereof. Preferably, these components are also durable and lightweight and able to withstand exposure to dirt and water. The springs can be any material typical of springs, for example, metal or any other known material in the art. The spring housing and/or punch housing can be the same material as the outer casing of the head. Thus, the outer casing of the head and the spring and/or punch housings may be one piece and formed together, e.g., via 3D printing, injection molding, machining, etc., and combinations thereof.

In alternative or additional embodiments, a $CO_2$ canister can be used in the place of the horizontal spring 90 to propel the punch out of the head of the device. In still further embodiments, the device can include a solenoid, which is an electromagnetic coil and sliding piston, to propel the punch out of the head of the device. Additional embodiments may include wind-up mechanisms to pull the punch into the head and then shoot the punch out of the head. These embodiments function by a gear (for example a butterfly gear) interacting with the punch to push the punch out of the device and/or pull the punch into the device. For example, each rotation of the gear may move the punch a predetermined distance.

Although various concepts of various embodiments have been described in conjunction with specific embodiments shown, While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention described herein is capable of other embodiments and of being practiced or of being carried out in various ways. It is to be understood that the phraseology and terminology used herein is for the purpose of description and should not be regarded as limiting.

What is claimed is:

1. A device for creating a hole in the ground, the device comprising:

a handle;

a device head interconnected to the handle, the device head comprising a front end and a rear end;

a punch extending outwardly from the front end of the device head, the punch comprising:

a tip on a first end;

a proximal end opposite the tip, the proximal end positioned in the device head;

a cylindrical portion between the tip and the proximal end;

an indention in the cylindrical portion and positioned a predetermined distance from the tip; and a stop ring positioned proximate the proximal end;

a racking lever interconnected to the punch, wherein one end of the racking lever engages the stop ring;

a trigger mechanism comprising a flange extending from an upper portion of the trigger mechanism;

a locking lever rotatable around a pivot point, wherein the locking lever comprises a cutout sized and shaped to receive a distal end of the flange, and wherein the locking lever comprises a locking lever head with a nose, the nose sized and shaped to engage the indention in the punch; and a spring interconnected to the rear end of the device head and the proximal end of the punch.

2. The device of claim 1, wherein the hole is sized and shaped to receive a golf tee.

3. The device of claim 1, wherein the trigger mechanism further comprises a trigger positioned on a front end of the handle and a spring interconnected to the trigger and a rear end of the handle.

4. The device of claim 1, wherein the device further comprises a tee extractor on the rear end of the device head.

5. The device of claim 1, wherein the locking lever head further comprises a butt end opposite the nose, wherein the butt end is interconnected to a biasing member, wherein the locking lever head is on one side of the pivot point and the cutout is on an opposite side of the pivot point.

6. The device of claim 1, wherein the racking lever can slide along a portion of the cylindrical portion of the punch.

7. The device of claim 1, wherein as the trigger mechanism is pulled, the flange of the trigger mechanism pushes on a tail end of the locking lever and rotates the locking lever around the pivot point, and wherein the tail end of the locking lever is on an opposite side of the pivot point as the locking lever head and nose.

8. The device of claim 1, wherein the punch extends outward from the front end of the device head a distance between about 1.25 inches and about 1.75 inches.

9. The device of claim 1, wherein a material of the punch comprises a metal, a hard plastic, a composite material, or combinations thereof.

10. A device for creating a hole in the ground, the device comprising:

a handle;

a head interconnected to the handle, the head comprising a front end, a rear end, and a cutout on a side;

a punch extending outwardly from the front end of the head, the punch comprising:

a tip on a first end;

a proximal end opposite the tip, the proximal end positioned in the head; and a cylindrical portion between the tip and the proximal end;

a racking lever interconnected to the punch proximate the proximal end, the racking lever having a distal end extending out of the cutout in the head;

a trigger mechanism; and a spring interconnected to the rear end of the head and the proximal end of the punch.

11. A method of using a device to punch a hole in the ground, comprising:

providing a device comprising:

a handle;

a device head interconnected to the handle, the device head comprising a front end and a rear end;

a punch extending outwardly from the front end of the device head, the punch comprising:

a tip on a first end;

a proximal end opposite the tip;

an indention a predetermined distance from the tip; and a stop ring positioned proximate the proximal end;

a racking lever interconnected to the punch, wherein one end of the racking lever engages the stop ring;

a trigger mechanism comprising a trigger;

a locking lever rotatable around a pivot point, wherein the locking lever comprises a locking lever head with a nose, the nose sized and shaped to engage the indention in the punch; and a spring interconnected to an inner surface on the rear end of the device head and the proximal end of the punch;

pulling the racking lever toward the rear end of the device head until the nose of the locking lever engages the indention in the punch;

compressing the trigger; and driving the punch out of the device head and into the ground.

12. The method of claim 11, wherein the pulling comprises engaging the racking lever with the stop ring and pulling the punch rearward along with the racking lever.

13. The method of claim 11, wherein the trigger mechanism comprises a spring interconnected to the trigger and an inner surface of a rear end of the handle, and wherein the spring returns the trigger to its original resting position.

14. The method of claim 11, wherein as the trigger is compressed a flange on the trigger mechanism pushes on a tail end of the locking lever and rotates the locking lever around the pivot point.

15. The method of claim 14, wherein as the locking lever rotates around the pivot point, the nose of the locking lever slides out of the indention in the punch.

16. The method of claim 15, wherein after the nose of the locking lever slides out of the indention in the punch, a force exerted by the spring propels the punch forward and out of the device head.

17. The method of claim 11, and wherein the tail end of the locking lever is on an opposite side of the pivot point as the locking lever head and nose.

18. The method of claim 11, further comprising rotating the racking lever into a notch in an outer casing of the device head, wherein the notch retains the racking lever and the punch in the loaded position and acts as a safety to prevent inadvertent firing of the punch.

19. The method of claim 11, wherein the device is pneumatic and comprises a piston, and wherein when air pressure above the piston is greater than below the piston, the piston is forced forward and pushes the punch forward and out of the device head.

20. The method of claim 11, wherein the device comprises a solenoid having an electromagnetic coil and a sliding piston, and wherein the method further comprises:

creating a magnetic field; and repelling the piston such that the piston pushes the punch out of the device head.

* * * * *